US007891387B2

(12) United States Patent
Lim et al.

(10) Patent No.: US 7,891,387 B2
(45) Date of Patent: Feb. 22, 2011

(54) MOBILE ROBOT SYSTEM HAVING LIQUID SUPPLY STATION AND LIQUID SUPPLY METHOD

(75) Inventors: Kwang-soo Lim, Seoul (KR); Sam-jong Jeung, Gwangju (KR); Jeong-gon Song, Gwangju (KR); Ju-sang Lee, Gwangju (KR); Jang-youn Ko, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 1259 days.

(21) Appl. No.: 11/484,564

(22) Filed: Jul. 12, 2006

(65) Prior Publication Data

US 2007/0051757 A1 Mar. 8, 2007

(30) Foreign Application Priority Data

Sep. 8, 2005 (KR) ..... 10-2005-0083561

(51) Int. Cl.
*B65B 3/04* (2006.01)

(52) U.S. Cl. ..... 141/98; 141/94; 141/198; 700/245; 180/167

(58) Field of Classification Search ..... 141/98, 141/198, 94; 700/245; 222/79; 180/167
See application file for complete search history.

(56) References Cited

U.S. PATENT DOCUMENTS

| | | | | |
|---|---|---|---|---|
| 5,238,034 | A * | 8/1993 | Corfitsen | 141/94 |
| 5,318,202 | A * | 6/1994 | D'Andrade | 222/78 |
| 5,628,351 | A * | 5/1997 | Ramsey et al. | 141/98 |
| 5,636,402 | A * | 6/1997 | Kubo et al. | 15/98 |
| 5,671,786 | A * | 9/1997 | Corfitsen | 141/94 |
| 5,735,959 | A * | 4/1998 | Kubo et al. | 118/663 |
| 6,237,647 | B1 * | 5/2001 | Pong et al. | 141/94 |
| 6,374,155 | B1 * | 4/2002 | Wallach et al. | 700/245 |
| 6,496,755 | B2 * | 12/2002 | Wallach et al. | 700/245 |
| 6,836,701 | B2 * | 12/2004 | McKee | 700/245 |
| 7,053,578 | B2 * | 5/2006 | Diehl et al. | 318/568.12 |
| 7,240,396 | B2 * | 7/2007 | Thomas et al. | 15/349 |
| 7,332,890 | B2 * | 2/2008 | Cohen et al. | 320/109 |
| 7,389,156 | B2 * | 6/2008 | Ziegler et al. | 700/245 |
| 7,555,363 | B2 * | 6/2009 | Augenbraun et al. | 700/253 |
| 2003/0212472 | A1 * | 11/2003 | McKee | 700/245 |
| 2004/0158357 | A1 | 8/2004 | Lee et al. | |
| 2006/0190134 | A1 * | 8/2006 | Ziegler et al. | 700/245 |

FOREIGN PATENT DOCUMENTS

| | | |
|---|---|---|
| CN | 85108395 A | 4/1986 |
| JP | 08-131382 | 5/1996 |

(Continued)

OTHER PUBLICATIONS

Machine translation of JP 2003-165077, Jun. 10, 2003, Fuji Photo Film Co. Ltd., all pages.*

(Continued)

*Primary Examiner*—Timothy L Maust
*Assistant Examiner*—Nicolas A Arnett
(74) *Attorney, Agent, or Firm*—Blank Rome LLP

(57) ABSTRACT

A robot system includes a supply station. The system further includes: a robot, a robot tank adapted to store a liquid and disposed at the robot; and a supply station configured to supply additional liquid to the tank.

15 Claims, 9 Drawing Sheets

FOREIGN PATENT DOCUMENTS

| | | | |
|---|---|---|---|
| JP | 11-192196 | A | 7/1999 |
| JP | 2001-315537 | A | 11/2001 |
| JP | 2002-068103 | A | 3/2002 |
| JP | 2002325707 | | 11/2002 |
| JP | 2003-165077 | | 6/2003 |
| JP | 2004351191 | | 12/2004 |
| JP | 2005-038805 | | 2/2005 |
| KR | 1020040079055 | A | 9/2004 |
| KR | 20-0381912 | | 4/2005 |
| RU | 94034395 | | 9/1996 |
| RU | 2130793 | | 5/1999 |
| SU | 1800482 | | 3/1993 |

OTHER PUBLICATIONS

Korean Intellectual Property Office, Official Action issued Jul. 21, 2006 with respect to Korean Patent Application No. 2005-83561 filed Sep. 8, 2005.

* cited by examiner

MOBILE ROBOT SYSTEM HAVING LIQUID SUPPLY STATION AND LIQUID SUPPLY METHOD

CROSS-REFERENCE TO RELATED APPLICATIONS

This application claims the benefit of priority under 35 U.S.C. §119 from Korean Patent Application No. 2005-83561, filed Sep. 8, 2005, the entire contents of which are incorporated herein by reference. This application may also be related to commonly owned U.S. patent application Ser. No. 10/682,484, filed Oct. 10, 2003, the entire contents of which are incorporated herein by reference.

BACKGROUND OF THE INVENTION

1. Field of the Invention

The present invention relates to a mobile robot. More particularly, the present invention relates to a mobile robot system having a liquid supply station configured liquid to a mobile robot, as well as a liquid supply method for the mobile robot system.

2. Description of the Related Art

By way of explanation, a mobile robot is a robot that travels by itself and performs task. Hereafter, the term "robot" includes a "mobile robot."

Generally, a robot has a power supply device that supplies power (for example, electric power), which enables the robot to move and perform a task. A rechargeable battery or a fuel cell may be used as the electric power supply device, as non-limiting examples. A non-limiting example of the fuel cell includes a methanol fuel cell. A robot using a methanol fuel cell may include a tank for storing methanol for the methanol fuel cell. When a robot using the methanol fuel cell moves or performs a given job, the robot consumes methanol. As a result, methanol stored in the tank runs out. So that the robot may continue to move, the tank should be refilled with methanol before the tank becomes empty.

Other robots may use water to perform their tasks. For example, robots such as steam-cleaning robots, wet mopping robots, cleaning robots, and humidifier robots may use water to perform specific jobs. Generally, these robots include at least one tank to store water to be used for performing their tasks. When the robots perform their jobs using water, water from the tank is consumed. So that the robots may continue their tasks, water should be supplied to the tank before the tank becomes empty.

When methanol or water in the tank runs out the robot may not operate. As a result, the robot time of use is limited.

SUMMARY OF THE INVENTION

The present invention has been developed in order to overcome the above drawbacks and other problems associated with the conventional arrangement. An aspect of the present invention is to provide a mobile robot system having a liquid supply station that automatically supplies the liquid such as water or methanol being used in the robots such that use of the robot becomes more convenient and usage hours of the robot increase.

To this end, a first non-limiting aspect of the present invention provides a system including a supply station, the system including: a robot; a robot tank adapted to store a liquid and disposed at the robot; and a supply station configured to supply additional liquid to the tank.

Another non-limiting aspect of the present invention provides robot system including a supply station, the system including: a robot including a fuel cell; a robot tank disposed at the robot and configured to store a fuel for the fuel cell; and a supply station configured to supply additional fuel based at least in part on a signal from the robot.

Yet another aspect provides a robot system including a supply station, the system including: a robot adapted to use water to perform a task; a robot tank disposed at the robot and configured to store the water; and a supply station adapted to supply the robot tank with additional water.

Another aspect of the invention provides a robot system including a supply station, the system including: a robot including fuel cell and adapted to use a liquid to complete a task; a fuel tank disposed at the robot; a liquid tank disposed at the robot; and a supply station configured to supply additional fuel and additional liquid.

Still another aspect of the invention provides a supply method for a robot, the method including: determining if the robot needs additional liquid; positioning the robot at a supply position of a supply station when additional liquid is required; and supplying the robot with the additional liquid.

BRIEF DESCRIPTION OF THE DRAWINGS

These and/or other aspects and advantages of the invention will become apparent and more readily appreciated from the following description of the embodiments, taken in conjunction with the accompanying drawings of which.

Throughout the drawings, like reference numerals will be understood to refer to like elements.

DETAILED DESCRIPTION OF THE EMBODIMENTS

Hereinafter, certain exemplary embodiments of the present invention will be described in detail with reference to the accompanying drawings. The following description, such as detailed configurations and elements thereof, are provided to assist in a comprehensive understanding of the invention. Thus, it is apparent that the present invention may be carried out in other ways known to those of skill in the art. Additionally, in the following description, well-known functions or configurations may be omitted to provide a clear and concise description of exemplary embodiments of the present invention.

A first non-limiting example of the present invention will be described with reference to a vacuum cleaning robot. A robot system according to the present invention may include a liquid supply station and a robot having a liquid tank.

The supply station supplies liquid to the liquid tank disposed in the mobile robot. The supply station may include a storage tank, a pump, a supply nozzle unit, a station controller, and a housing, among other things. The controller may control the pump and the supply nozzle unit so that liquid from the storage tank may be supplied to the tank of the robot.

The robot travels and performs a given job such as cleaning. The present invention is especially applicable to robots that use liquid to move or to perform a given job. For example, one type of robot obtains electrical power from a fuel cell using a liquid fuel such as methanol. Another type of robot may use water to perform tasks such as water cleaning, steam cleaning, wet mopping, or humidifying.

Figure 1:
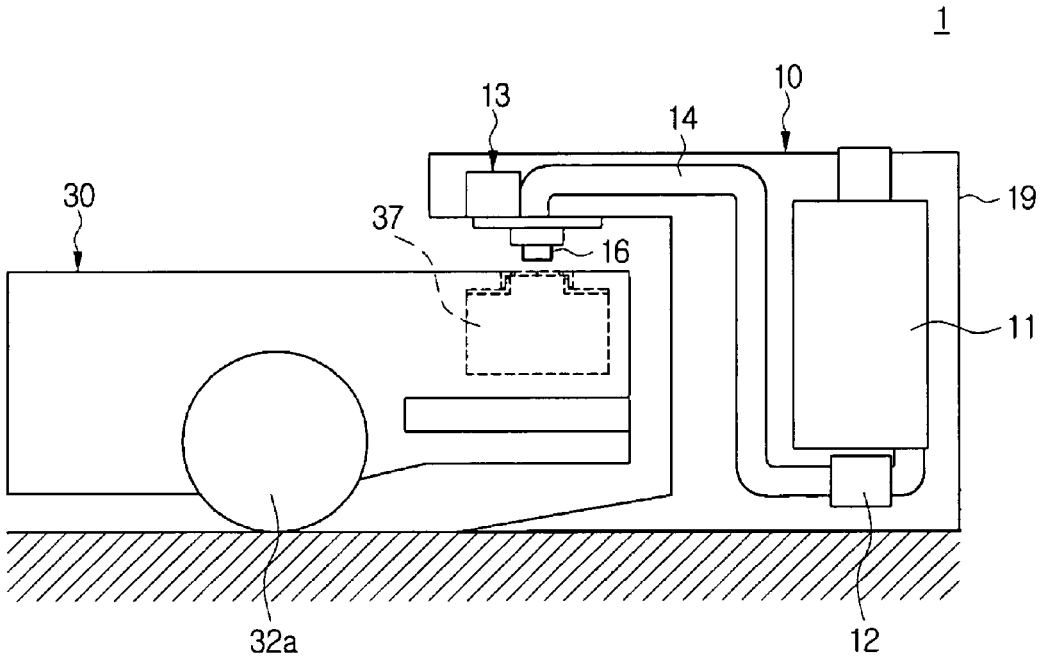
FIG. 1 is a view illustrating robot system having a supply station according to a first non-limiting embodiment of the present invention.
Figure 2:
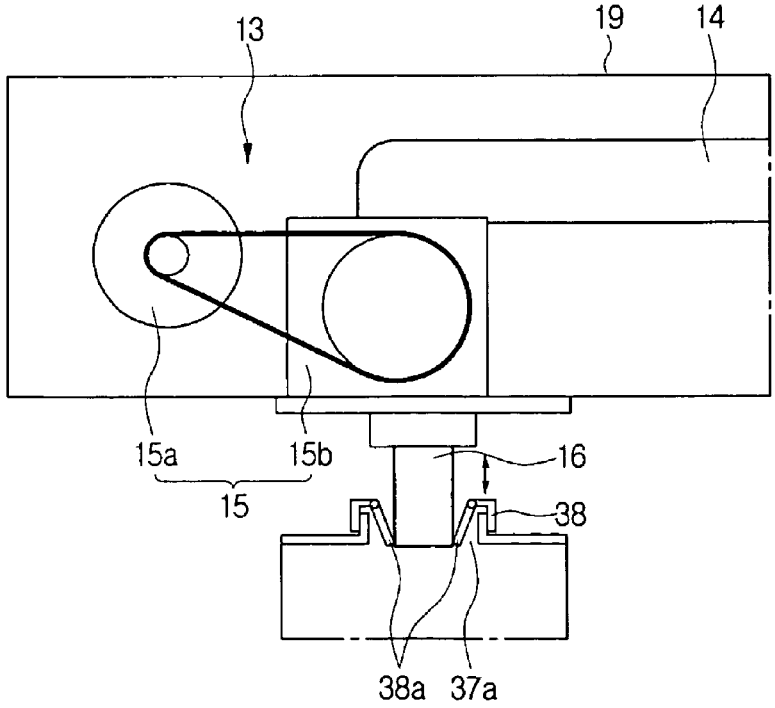
FIG. 2 is a view illustrating a non-limiting example of a supply nozzle unit of the robot system shown in FIG. 1.
Figure 3:
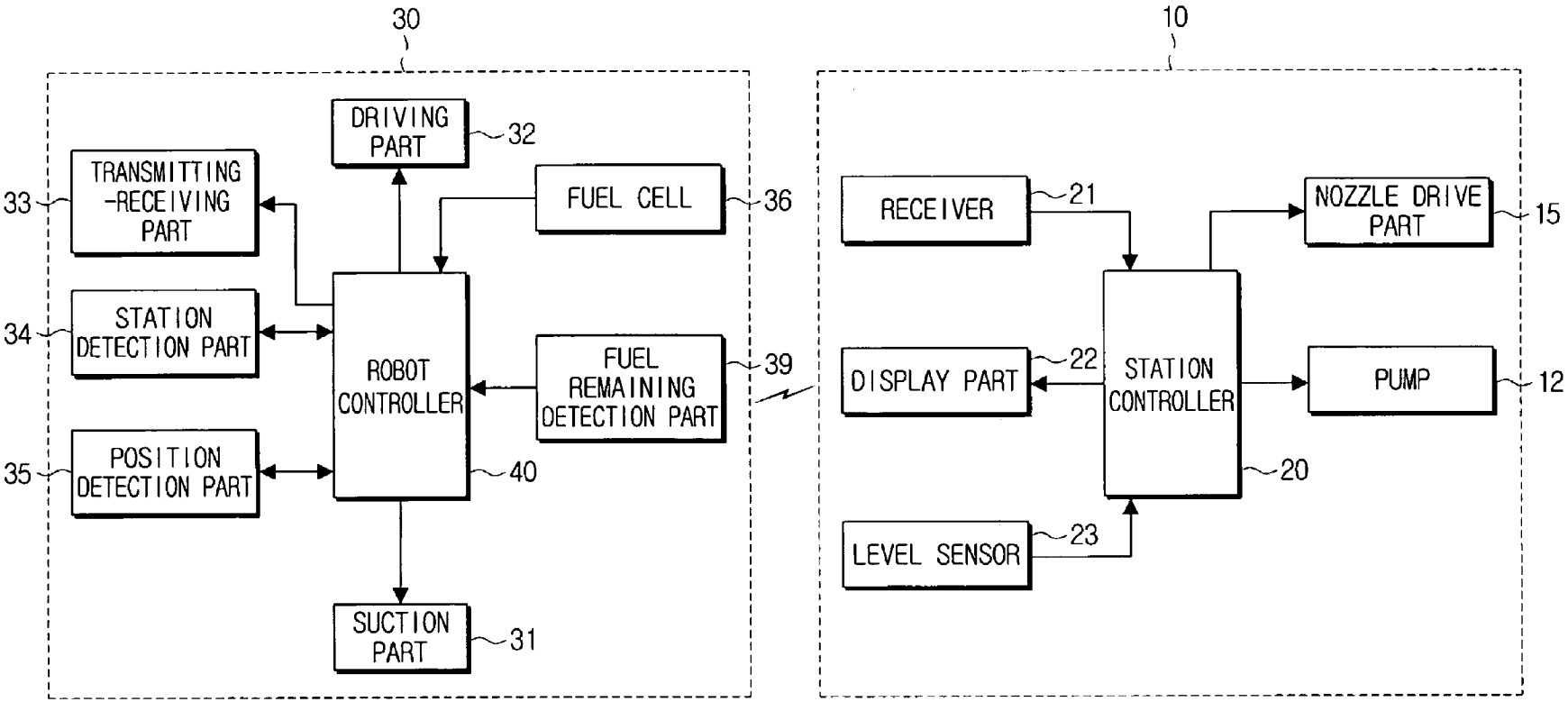
FIG. 3 is a block diagram illustrating a non-limiting example of the operation of the robot system shown in FIG. 1.

FIGS. 1 to 3 illustrate a robot system having a supply station according to a first non-limiting embodiment of the present invention. This non-limiting embodiment relates to a robot system having a supply station, such as a robot that may use a methanol fuel cell. Although this non-limiting example refers to methanol, other fuels know to those of skill in the art are within the scope of the present invention. Referring to FIGS. 1 to 3, the robot system 1 having the supply station according to the first embodiment of the present invention may include the supply station 10 and a robot 30 having a tank 37.

The supply station 10 may be configured to supply methanol (or other fuel) to the tank 37 of the robot 30. The supply station 10 may include a storage tank 11, a pump 12, a supply nozzle unit 13, a station controller 20, and a housing 19.

The storage tank 11 may store a predetermined quantity of methanol to supply to the tank 37 of the robot 30. The storage tank 11 may be many times larger than the tank 37 of the robot 30. As a result, storage tank 11 may fill up the tank 37 several times.

The pump 12 may be in fluid communication with the storage tank 11 and may supply the tank 37 with methanol stored in the storage tank 11. It may be preferable that the pump 12 be disposed at a lower portion of the storage tank 11.

The supply nozzle unit 13 may be in fluid communication with the pump 12 and may serve as a passage through which the methanol is supplied to the tank 37. The supply nozzle unit 13 may include a connecting pipe 14, a supply nozzle 16, and a nozzle drive part 15.

The connecting pipe 14 may be disposed between the supply nozzle 16 and the pump 12. The methanol being discharged by the pump 12 may flow to the supply nozzle 16 through the connecting pipe 14. The nozzle drive part 15 may be configured to reciprocate the supply nozzle 16. A front end of the supply nozzle 16 may be inserted into an inlet port 37*a* of the tank 37. The nozzle drive part 15 may include a drive motor 15*a* and a drive mechanism 15*b*. Any mechanism capable of converting a rotary motion of the drive motor 15*a* into a linear motion can be used for the drive mechanism 15*b*. When the supply nozzle 16 is moved down by the nozzle drive part 15, the front end of the supply nozzle 16 may be inserted into the inlet port 37*a* of the tank 37. Therefore, when methanol is supplied from the storage tank 11 to the tank 37, the methanol does not leak out.

When station controller 20 receives a supply signal from the robot 30, the station controller 20 may control the pump 12 and the supply nozzle unit 13 to supply methanol stored in the storage tank 11 to the tank 37. In other words, when the station controller 20 receives the supply signal from the robot 30 through receiver 21, the station controller 20 may control the drive motor 15*a* of the supply nozzle unit 13 to insert the supply nozzle 16 into the inlet port 37*a* of the tank 37.

Then the station controller 20 may start the pump 12 to supply methanol from the storage tank 11 to the tank 37. The pump 12 may include a constant flow pump, such as a metering pump that supplies liquid at a constant rate per second. Therefore, the station controller 20 may control a quantity of liquid being supplied to the tank 37 if the station controller 20 controls operation time of the pump 12. Also, the station controller 20 may stop the pump 12 upon receiving a stop signal from robot controller 40 of the robot 30.

The housing 19 may house the storage tank 11, the pump 12, the supply nozzle unit 13, and the station controller 20. The housing 19 may fix the supply station 10 at a predetermined position.

Furthermore, the supply station 10 may preferably include a level sensor 23 and a display part 22. The level sensor 23 may be disposed at the storage tank 11 and may detect a level of the liquid (e.g., methanol) stored in the storage tank 11. The display part 22 may display a quantity of the liquid stored in the storage tank 11 an operation state of the supply station 10, as well as other desired information. The station controller 20 may display an alarm through the display part 22 when the level of the storage tank 11 detected by the level sensor 23 is less than a desired level. This alarm may signal a need to replenish the liquid in the storage tank 11.

The robot 30 may travel by itself and may perform a given job using power obtained from the methanol fuel cell 36. The robot 30 may include a suction part 31, a driving part 32, a transmitting-receiving part 33, a position detection part 35, a station detection part 34, a fuel cell 36, a tank 37, a fuel remaining detection part 39, and a robot controller 40.

The suction part 31 may clean a surface on which the robot 30 is traveling by sucking in contaminants from the surface. The suction part 31 may have a vacuum generator configured to generate a suction force and a dust collecting unit configured to separate and collect the contaminants.

The driving part 32 enables the robot 30 to move in any direction. The driving part 32 may generally include plurality of wheels 32*a* and a plurality of motors (not shown) that drive the plurality of wheels 32*a*.

The transmitting-receiving part 33 may receive a control signal being transmitted from a remote control apparatus (not shown) and may transmit a supply signal of the robot controller 40 to the supply station 10.

The position detection part 35 may detect a current location of the robot 30. The position detection part 35 may use a general position detecting method such as a position detecting method using a vision camera and/or a vision board.

The station detection part 34 may detect the position of the supply station 10. A camera and/or a vision board may be included in the station detection part 34. Also, ultrasonic sensors or laser sensors may be included in the station detection part 34. Transmitters for the ultrasonic sensors or laser sensors may be disposed at the supply station 10.

The fuel cell 36 may supply the robot 30 with power for operating. While various types of fuel cells may be used, this non-limiting embodiment uses methanol fuel cell 36.

The tank 37 may be configured to store a predetermined quantity of methanol that is consumed as the robot 30 operates. The tank 37 may include inlet port 37*a* into which the supply nozzle 16 is inserted at upper portion of the tank 37. Also, the inlet port 37*a* may preferably include inlet port cap 38 that may be opened and closed by the supply nozzle 16. In other words, when the supply nozzle 16 descends, the inlet port cap 38 may be opened and the supply nozzle 16 may be inserted into the interior of the inlet port 37*a*. When the supply nozzle 16 rises, the inlet port 37*a* may be closed automatically to prevent the liquid being stored in the tank 37 from flowing out or vaporizing out through inlet port 37*a*. The inlet port cap 38 according to the present non-limiting embodiment may have two cap doors 38*a* elastically supported by an elastic member (not shown). When the supply nozzle 16 descends, the cap doors 38*a* may move down and the supply nozzle 16 may be inserted into inlet ports 37*a*. When the supply nozzle 16 rises, the cap doors 38*a* may be moved up by the elastic member and to close the inlet port 37*a*, as shown in FIG. 1. The inlet port cap 38 may include any suitable inlet port cap. For example, an inlet port cap for a fuel tank of a car may be used. The fuel remaining detection part 39 may detect a quantity of methanol remaining in the tank 37 and may send a fuel remaining signal to the robot controller 40.

The robot controller 40 may be configured to interpret control signals that the transmitting-receiving part 33 receives. According to the received control signals, the robot controller 40 may control the suction part 31, the driving part 32, the position detection part 35, and the station detection part 34 to move or to perform a given job.

Furthermore, the robot controller 40 may ascertain a quantity of the fuel stored in the tank 37 through signals received from the fuel remaining detection part 39. When the level of the fuel in tank 37 falls below a certain level, the robot controller 40 may move the robot 30 to the supply station 10 to refuel. In other words, after the robot controller 40 recognizes a location of the supply station 10 via the station detection part 34, the robot controller 40 may control the driving part 32 so that the robot 30 moves to the supply station 10. The robot may move to a position proximate to the supply station 10 such that the inlet port 37*a* of the tank 37 of the robot 30 is located near the supply nozzle 16 of the supply station 10. The robot controller 40 may transmit a supply request signal to the supply station 10. The station controller 20 may then control the pump 12 and the supply nozzle unit 13 to supply the tank 37 with the fuel from tank 11. When the level of fuel in the tank 37 reaches a desired level, the robot controller 40 may transmit a stop request signal to the supply station 10, so that the supply station 10 stops supplying methanol.

The robot 30 may determine that a level of fuel stored in tank 37 is below a certain (low threshold) level. The low threshold level may be determined based on the specifications for the tank 37 and the fuel cell 36.

When the level of fuel in tank 37 is lower than the low threshold, the robot controller 40 of the robot 30 may locate supply station 10 using station detection part 34. Robot controller 40 may then move the robot 30 to the liquid supply station 10. At this time, the supply nozzle 16 of the liquid supply station 10 may be at an upper position, as shown in FIG. 1. The robot controller 40 may use methods known to those of skill in the art to position the robot 30 at the supply position.

When the robot 30 reaches the supply position, the robot controller 40 may transmit a supply signal to the supply station 10 through the transmitting-receiving part 33. The receiver 21 of the supply station 10 may receive a supply signal from robot 30 and may send it to the station controller 20. The station controller 20 may control the nozzle drive part 15 of the supply nozzle unit 13 to move the supply nozzle 16 down. When the supply nozzle 16 descends, the front end of the supply nozzle 16 pushes the cap doors 38*a* of the inlet port cap 38 so that it enters the inlet port 37*a* of the tank 37, as shown in FIG. 2.

When the supply nozzle 16 is inserted into the inlet port 37*a*, the station controller 20 may signal the pump 12 to begin pumping. When the pump 12 operates, fuel from the storage tank 11 may be supplied to the tank 37 through the connecting pipe 14 and the supply nozzle 16. The station controller 12 may signal the pump 12 to stop after a desired time has elapsed (which may be predetermined) or when it receives a stop signal from the robot controller 40. The station controller 20 may return the supply nozzle 16 to its original position. After refueling is completed, the robot controller 40 of the robot 30 may control the driving part 32 to resume the given job.

Figure 4:
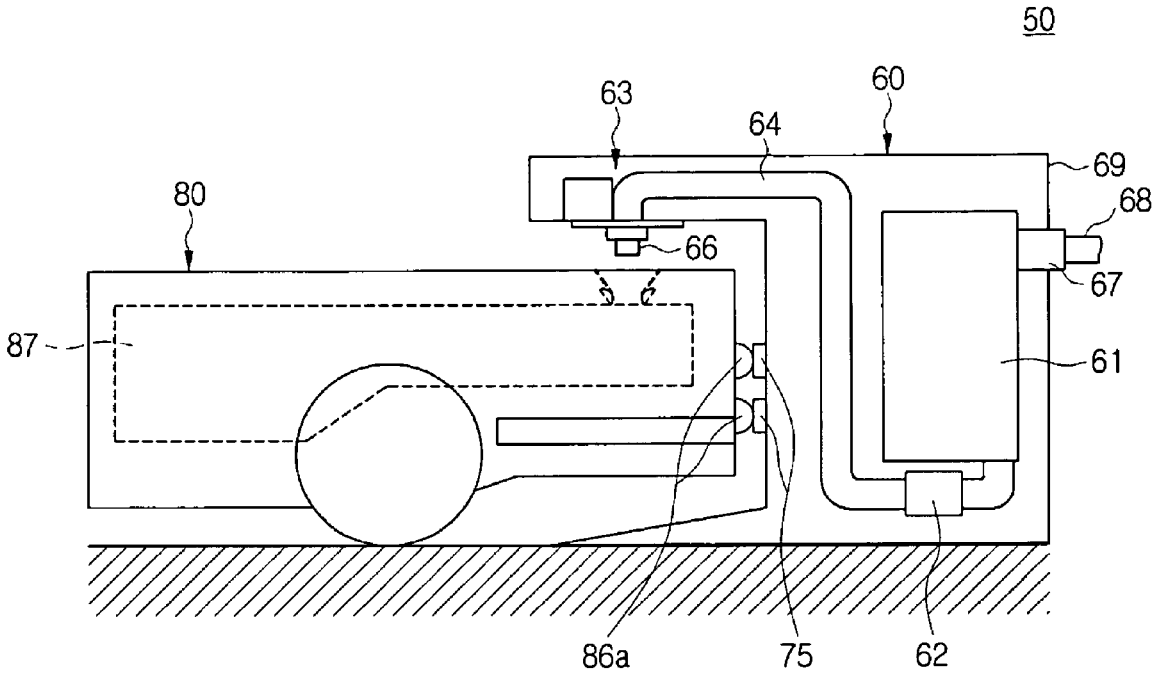
FIG. 4 illustrates a robot system having a supply station according to a second non-limiting embodiment of the present invention.
Figure 5:
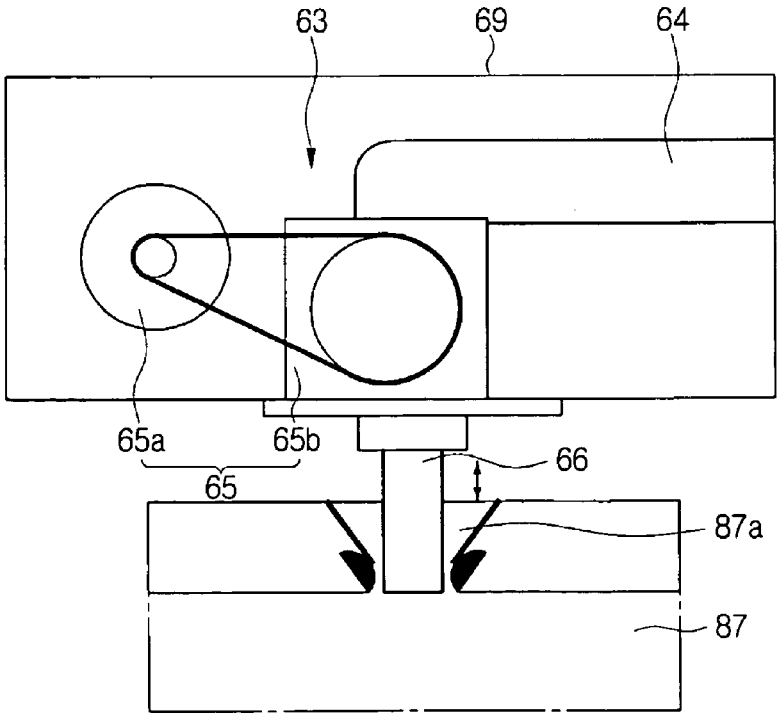
FIG. 5 illustrates a non-limiting example of a supply nozzle unit of the robot system shown in FIG. 4.
Figure 6:
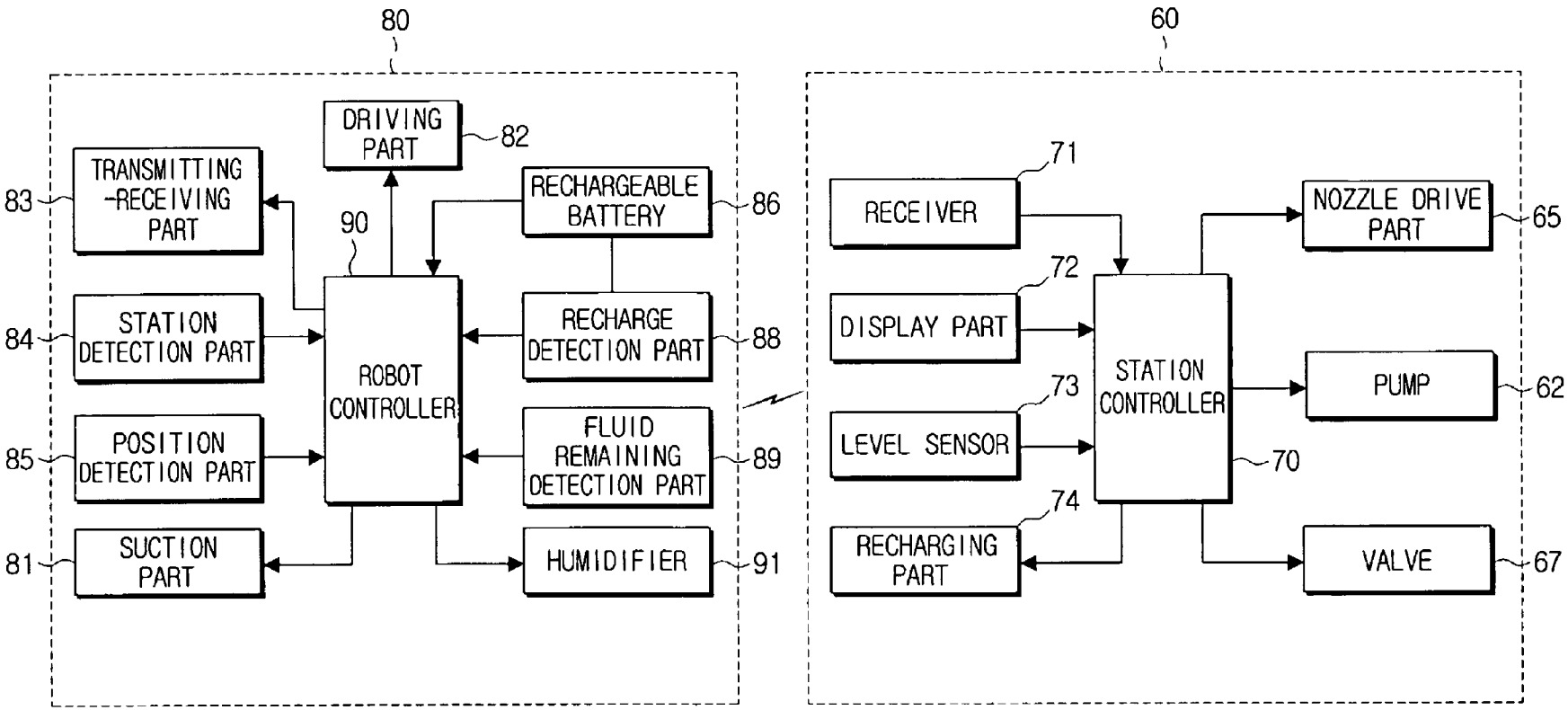
FIG. 6 is a block diagram illustrating a non-limiting example of the operation of the robot system shown in FIG. 4.

FIGS. 4 to 6 show a robot system having a supply station according to a second non-limiting embodiment of the present invention. The second non-limiting embodiment relates to a robot system 50 having a supply station for robot 80, which is fueled by a rechargeable battery and uses a liquid, such as water, to complete at least one task. The robot system 50 having the supply station may include supply station 60 and robot 80, which may have a tank 87.

The supply station 60 may be configured to supply tank 87 with a liquid useful for completing at least one task. In this non-limiting example, water is provided. However, other suitable liquids may also be provided. The supply station 60 may include storage tank 61, pump 62, supply nozzle unit 63, recharging part 74, station controller 70, and housing 69.

The storage tank 61 may be configured to store a predetermined quantity of water to supply to the tank 87 of the robot 80. The storage tank 61 may be connected to a water service pipe 68 to obtain water. The water service pipe 68 may have a valve 67 (such as an automatic valve) that opens and closes the water service pipe 68. It is convenient to supply storage tank 61 with water when the storage tank 61 is connected to the water service pipe 68 with the automatic valve 67. The water pressure being applied to the pump 62 may be maintained within a desired range because the storage tank 61 maintains a desired quantity of water in storage. Therefore the pump 62 may supply a constant quantity of water from the storage tank 61 to the tank 87.

The recharging part 74 may be configured to recharge the rechargeable battery 86 of the robot 80 according to a signal from the station controller 70. The recharging part 74 may include recharging terminals 75 connected to battery terminals 86*a*.

The pump 62, the supply nozzle unit 63, the station controller 70, and the housing 69 may be the same or similar to that described above in the first non-limiting embodiment. The nozzle drive part 65 of the supply nozzle unit 63 may have drive motor 65*a* and drive mechanism 65*b*. When water in the storage tank 61 becomes lower than a desired level, the station controller 70 may control the automatic valve 67 to open so that water flows from the water service pipe 68 to the storage tank 61.

Furthermore, the supply station 60 may preferably include a level sensor 73 and a display part 72. The level sensor 73 may be disposed at the storage tank 61 and may detect a level of the liquid (e.g., water) stored in the storage tank 61. The display part 72 may display a quantity of the liquid stored in the storage tank 61 an operation state of the supply station 60, as well as other desired information. The station controller 70 may display an alarm through the display part 72 when the level of the storage tank 61 detected by the level sensor 73 is less than a desired level. This alarm may signal a need to replenish the liquid in the storage tank 61.

The robot 80 may be configured to travel and to perform a desired task using power obtained from the rechargeable battery 86. The robot 80 may include suction part 81, driving part 82, transmitting-receiving part 83, position detection part 85, station detect part 84, rechargeable battery 86, tank 87, a fluid remaining detection part 89, humidifier 91, and robot controller 90.

The rechargeable battery 86 may supply robot 80 with power to operate. Rechargeable battery 86 may include recharge detection part 88 configured to detect a state of the rechargeable battery 86. When a power level of the rechargeable battery 86 falls below a desired capacity, the recharge detection part 88 may send a recharge signal to the robot controller 90. As such, the rechargeable battery 86 may be recharged. Methods of recharging a rechargeable battery 86 known to those of skill in the art are within the scope of the present invention.

The tank 87 may store a predetermined quantity of fluid that the robot 80 may use to perform a desired task. The tank 87 may include an inlet port 87*a* into which the supply nozzle 66 may be inserted at an upper portion of the liquid tank 87. The inlet port 87*a* may be substantially formed as a funnel. Although not shown, the inlet port cap 38 may be disposed in the inlet port 87*a* as in the first non-limiting embodiment described above, if desired. The fluid remaining detection part 89 may be configured to detect a level of fluid stored in the tank 87 and may send a signal indicating a detected fluid level to the robot controller 90.

In this non-limiting example, the task to be performed by the robot 80 includes humidifying. Accordingly, robot 80 may include a humidifier 91. The humidifier 91 increases the amount of moisture in the air according to a signal from robot controller 90. The tank 87 may supply humidifier 91 with water.

The robot controller 90 may be configured to interpret control signals received by transmitting-receiving part 83. According to the received control signals, the robot controller 90 may control suction part 81, driving part 82, position detection part 85, and the station detection part 84 so that the mobile robot 80 moves or performs the desired task. The robot may be controlled to perform desired tasks, as known to those of skill in the art.

Furthermore, the robot controller 90 may ascertain a quantity of fluid stored in tank 87 through the fluid remaining detection part 89. When the water level of the tank 87 falls below a desired level, the robot controller 90 may move the mobile robot 80 to the supply station 60 so that the storage tank 61 may supply tank 87 with water. The manner in which the robot controller 90 may control mobile robot 80 to be supplied with water from the storage tank 61 may be similar to that of supply of fluid in the first non-limiting embodiment described above.

Hereinafter, operations of the mobile robot system 50 according to the second non-limiting embodiment will be described. The robot 80 may determine if a level of fluid stored in tank 87 falls below a desired level. The desired level may be determined by specifications of tank 87 and humidifier 91.

When tank 87 is ready for refilling, the robot controller 90 of the robot 80 may signal the robot 80 to stop its task. Robot controller 90 may locate the supply station 60 via the station detection part 84. Robot controller 90 may cause the mobile robot 80 to move to a supply position at supply station 60. Supply nozzle 66 of the supply station 60 may be at an upper position, as shown in FIG. 4.

When the mobile robot 80 locates the supply position, the robot controller 90 may transmit a supply signal to the liquid supply station 60 through the transmitting-receiving part 83. The receiver 71 of the supply station 60 may receive a supply signal from the robot 80 and may send it to the station controller 70. The station controller 70 may then drive the nozzle part 65 of the supply nozzle unit 63 to move the supply nozzle 66 down. When the supply nozzle 66 lowers, a front end of the supply nozzle 66 may be inserted into the inlet port 87*a* of the tank 87, as shown in FIG. 5.

When the supply nozzle 66 is inserted into inlet port 87*a*, the station controller 70 may start operation of pump 62. When pump 62 operates, water from the storage tank 61 may be supplied to tank 87 through the connection pipe 64 and the supply nozzle 66. Then the station controller 70 stops the pump 62 after a desired time or when it receives a stop signal from the robot controller 90. After resupply is completed, the robot controller 90 of the mobile robot 80 may control the driving part 82 to resume the desired task.

A quantity of water stored in the storage tank 61 of the supply station 60 decreases when supply station 60 supplies water to tank 87. The station controller 70 may detect a level of water in the storage tank 61 via level sensor 73. When level of liquid in tank 61 falls below a desired level, the station controller 70 may open the valve 67. Then water flowing out of the water service pipe 68 may fill the storage tank 61. When the fluid level in the storage tank 61 reaches a desired level, the station controller 70 may close the valve 67 to stop supply of fluid.

Figure 7:
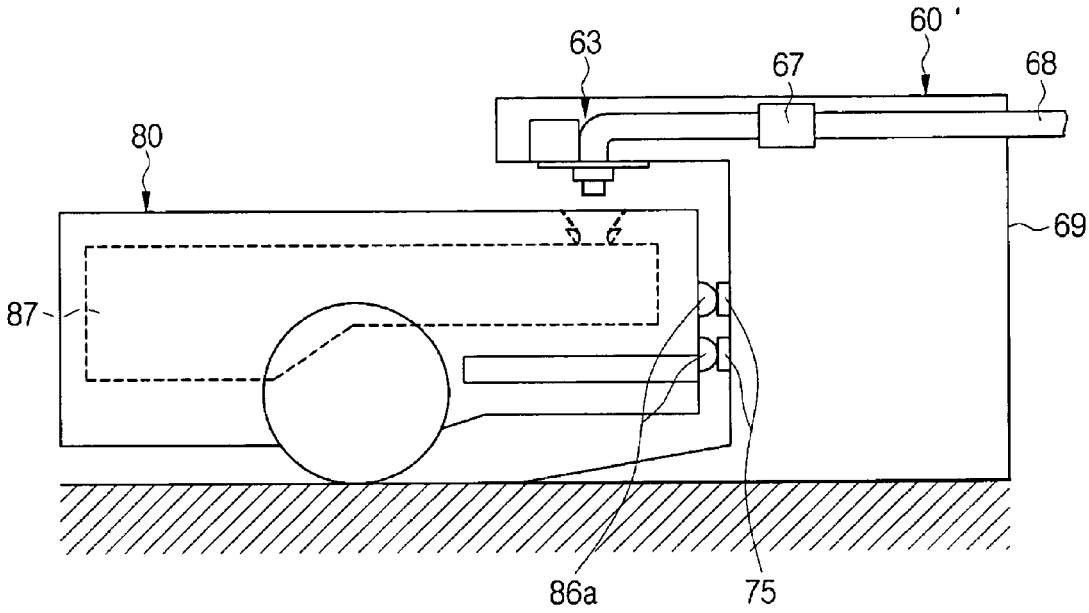
FIG. 7 is a view illustrating another non-limiting example of a supply station of the robot system shown in FIG. 4.
Figure 8:
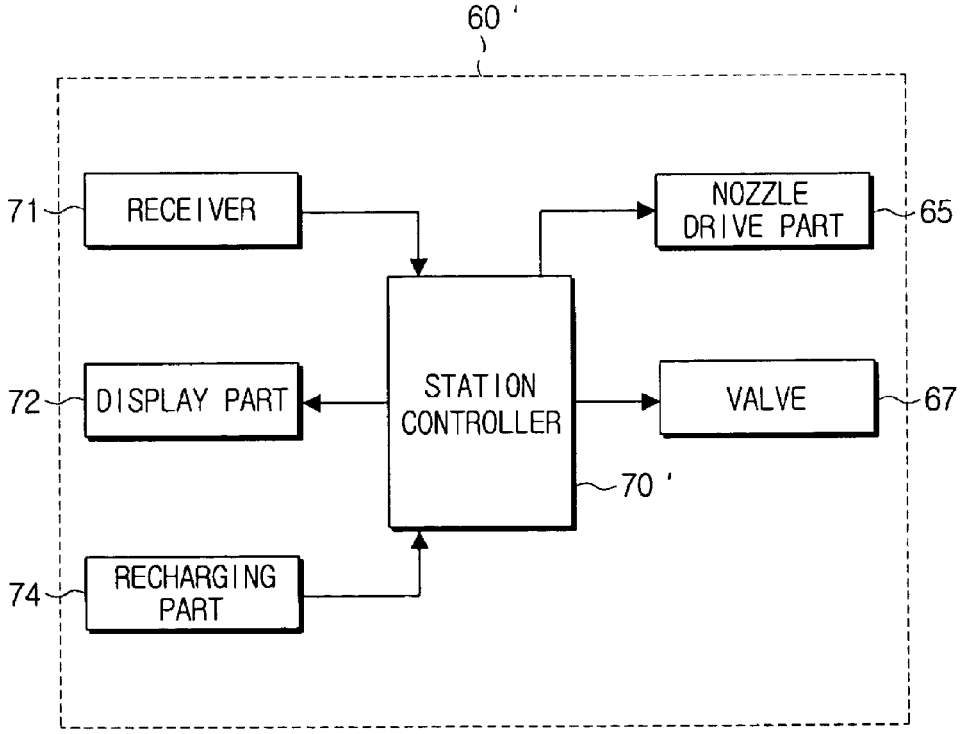
FIG. 8 is a block diagram illustrating a non-limiting example of the operation of the supply station shown in FIG. 7, FIG. 9 illustrated a non-limiting example of a robot system having a supply station according to a third non-limiting embodiment of the present invention.

FIGS. 7 and 8 show another non-limiting embodiment of the liquid supply station. The liquid supply station 60' may have water service pipe 68, which may be directly connected to the supply nozzle unit 63. The valve 67 may be disposed between the supply nozzle unit 63 and the water service pipe 68 to open or close the water service pipe 68. The liquid supply station 60' may not include the storage tank 61 and the pump 62 of the non-limiting second embodiment. Therefore, when supplying water to the tank 87 of the robot 80, the water may be directly supplied from water service pipe 68 to tank 87.

Referring to FIGS. 7 and 8, liquid supply station 60' may include supply nozzle unit 63 directly connected to water service pipe 68. When receiving a supply signal from the robot controller 90, the station controller 70' may open valve 67 (such as an automatic valve) so that water flows from water service pipe 68 to tank 87. When receiving a stop signal from the robot controller 90, the station controller 70 may close the valve 67 to stop the flow of water.

Although the robot 80 described above may include humidifier 91 as an apparatus using fluid from tank 87, this is for illustrative purposes only. The robot 80 may additionally or alternatively include a water cleaning apparatus, a steam cleaning apparatus, a wet mopping apparatus, as well as other fluid cleaning devices known to those of skill in the art.

Figure 9:
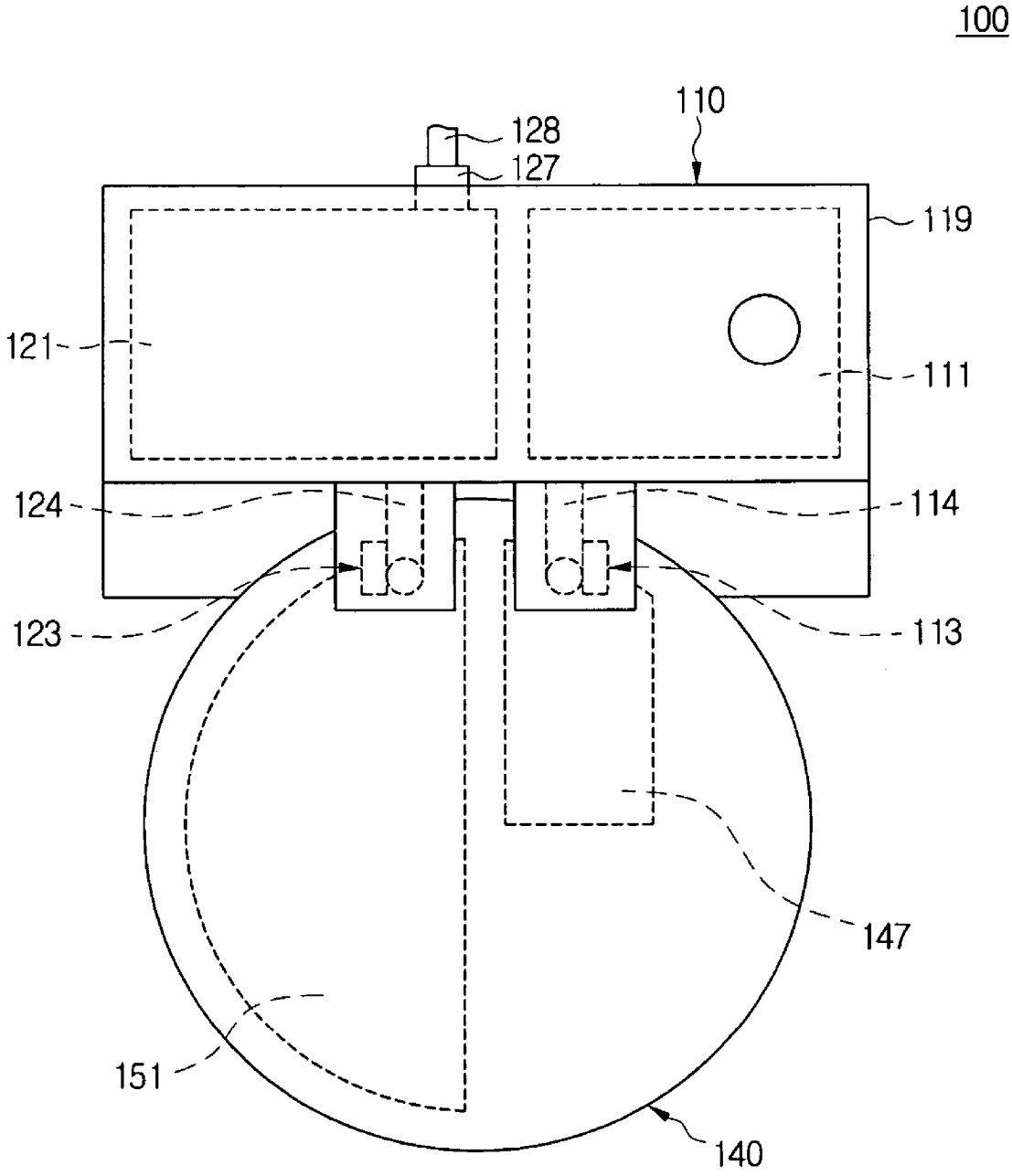
Figure 10:
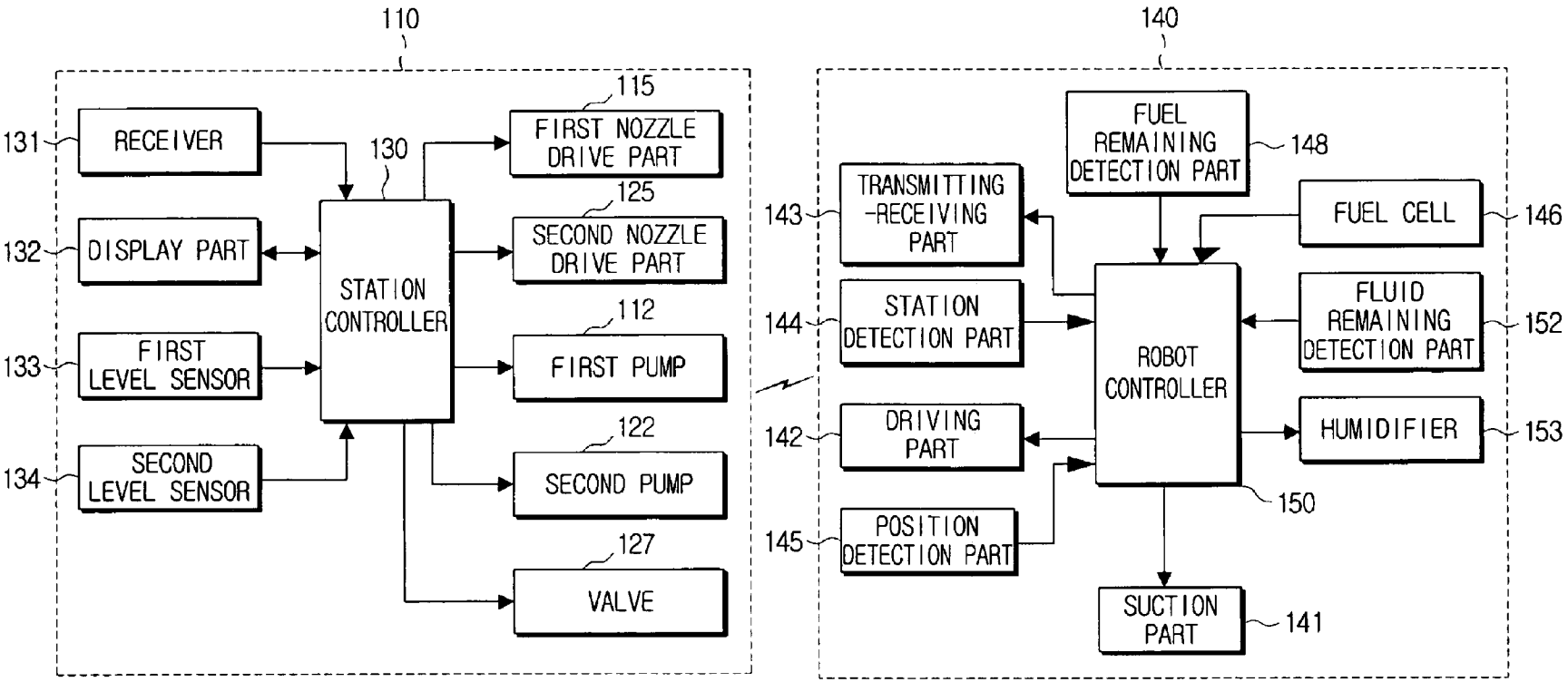
FIG. 10 is a block diagram illustrating a non-limiting example of the operation of the robot system shown in FIG. 9.

FIGS. 9 and 10 illustrate a robot system having a supply station according to a third non-limiting embodiment of the present invention. The third non-limiting embodiment includes a robot system 100 having a supply station for a robot that obtains power from a methanol fuel cell and performs a desired task using water.

Robot system 100 having a liquid supply station according to the third non-limiting embodiment includes a supply station 110 and a robot 140 having fuel (e.g., methanol) tank 147 and a fluid (e.g., water) tank 151. The supply station 110 may supply tank 147 and tank 151 of the robot 140 with methanol (or other fuels) and water (or other desired fluids), respectively. The supply station 110 may include storage tank 111, a storage tank 121, first and second pumps 112 and 122, first and second supply nozzle units 113 and 123, station controller 130, and housing 119.

The storage tank 111 may store a predetermined quantity of fuel (e.g., methanol) to supply to tank 147 of robot 140. The storage tank 121 may provide a predetermined quantity of fluid to tank 151 of robot 140. The storage tank 121 may be connected to a water service pipe 128 to supply water. The water service pipe 128 may have an valve 127 (such as an automatic valve) that opens and closes the water service pipe 128. Connection of the storage tank 121 and the water service pipe 128 having the automatic valve 127 makes it convenient to supply the storage tank 121 with water.

The first pump 112 may be in fluid communication with the storage tank 111 and may supply tank 147 with the fuel (e.g., methanol) stored in the storage tank 111. It may be preferable that the first pump 112 be disposed at a lower portion of the storage tank 111. The second pump 122 may be in fluid communication with the storage tank 121 and may supply tank 151 with the fluid stored in the storage tank 121. It may be preferable that the second pump 122 be disposed at a lower portion of the storage tank 121.

The first and second supply nozzle units 113 and 123 may be in fluid communication with the first and second pump 112 and 122 and may serve as passages through which the fuel and the fluid flow to tank 147 and tank 151, respectively. The first and second supply nozzle units 113 and 123 may include first and second connect pipes 114 and 124, first and second supply nozzles (not shown), and first and second nozzle drive parts 115 and 125, respectively.

The first connect pipe 114 may be disposed between the first supply nozzle and the first pump 112. The methanol discharged by the first pump 112 may flow to the first supply nozzle through the first connect pipe 114. The second connect pipe 124 may be disposed between the second supply nozzle and the second pump 122. The fluid discharged by the second pump 122 may flow to the second supply nozzle through the second connect pipe 124.

The first and second nozzle drive part 115 and 125 may reciprocate the first and second supply nozzles, respectively, up and down in a straight line. Each front end of the first and second supply nozzle may be inserted into inlet ports of tank 147 and tank 151. The first and second nozzle drive parts 115 and 125 each may have a drive motor and a drive mechanism. Any mechanism capable of converting a rotary motion of the drive motor into an up and down linear motion of the supply nozzle can be used for the drive mechanism.

When the first and second supply nozzles are moved down by the first and second nozzle drive parts 115 and 125, respectively, each front end of the first and second supply nozzle may be inserted into each inlet port of tank 147 and tank 151. Therefore, when the fuel and the fluid are supplied from the storage tank 111 and the storage tank 121 to tank 147 and tank 151, the fuel and the fluid do not leak out.

When the station controller 130 receives a supply signal from the robot 140, the station controller 130 may control the first and second pumps 112 and 122 and the first and second supply nozzle units 113 and 123 to supply the fuel and the fluid stored in the storage tank 111 and the storage tank 121 to tank 147 and tank 151. In other words, when the station controller 130 receives a fuel supply signal from the mobile robot 140 through receiver 131, the station controller 130 may control the first nozzle drive part 115 of the first supply nozzle unit 113 to insert the first supply nozzle into the inlet port of the tank 147. Then the station controller 130 may start the first pump 112 to supply the fuel from storage tank 111 to tank 147.

When the station controller 130 receives a fluid supply signal from the robot 140 through the receiver 131, the station controller 130 may control the second nozzle drive part 125 of the second supply nozzle unit 123 to insert the second supply nozzle into the inlet port of the tank 151. Then the station controller 130 may start the second pump 122 to supply fluid from tank 121 to tank 151. The first and second pump 112 and 122 may include constant flow pumps such as metering pumps that supply liquid at a constant rate per second. Therefore, the station controller 130 may control a quantity of fuel and fluid supplied to the tank 147 and the tank 151 if the station controller 130 controls operation time of the first and second pumps 112 and 122, respectively. Also, the station controller 130 may stop either of the first and second pumps 112 and 122 when receiving a stop signal from a robot controller 150 of the robot 140, thereby controlling a quantity of fuel and fluid being supplied to tank 147 and tank 151.

The housing 119 may house storage tank 111, storage tank 121, first and second pumps 112 and 122, first and second supply nozzle units 113 and 123, and station controller 130. The housing 119 may fix the supply station 110 at a predetermined position.

Furthermore, the supply station 110 may preferably include first and second level sensors 133 and 134 and a display part 132. The first and second level sensors 133 and 134 may be disposed at storage tank 111 and storage tank 121, respectively, and may detect levels of fuel and fluid stored in the storage tank 111 and the storage tank 121, respectively. The display part 132 may display a quantity of the fuel and the fluid being stored in the storage tank 111 and the storage tank 121, respectively, as well as an operation state of supply station 110. The station controller 130 may display an alarm through the display part 132 when a fuel level in the storage tank 111 being detected by the first level sensor 133 and/or a fluid level in the storage tank 121 being detected by the second level sensor 134 are less than a desired level.

The robot 140 may travel by itself and perform a desired task using power obtained from a power source such as methanol fuel cell 146. The robot 140 may include suction part 141, driving part 142, transmitting-receiving part 143, position detection part 145, station detection part 144, the methanol fuel cell 146, fuel tank 147, a fuel remaining detection part 148, fluid tank 151, fluid remaining detection part 152, humidifier 153, and robot controller 150.

The robot 140 may be substantially the same as or similar to robot 80 described in the non-limiting second embodiment, except that it may have tank 147 and fuel remaining detection part 148. The methanol fuel cell 146, the fuel tank 147, and the fuel remaining detection part 148 may be similar to the first non-limiting embodiment of the present invention.

According to a third non-limiting embodiment, illustrated in FIGS. 9 and 10, the robot 140 may determine if a level of the fluid stored in tank 151 falls below a desired fluid level via fluid remaining detection part 152. Also the mobile robot 140 may determine if a level of the fuel stored in tank 147 falls below a desired fuel level via the fuel remaining detection part 148. The desired fluid level and the desired fuel level are respective quantities of the fluid and the fuel that tank 151 and tank 147 may be determined by specifications of the tank 151, the humidifier 153, the tank 147, and the fuel cell 146.

The procedure with which the mobile robot 140 obtains fuel and/or fluid may be substantially the same as those of the first and second non-limiting embodiments described above. However, the robot 140 may simultaneously fill up tank 147 with fuel while filling up tank 151 with fluid, according to the non-limiting third embodiment. As a result, a frequency at which robot 140 returns to the supply station 110 is reduced, and a working time of the robot increases.

Figure 11:
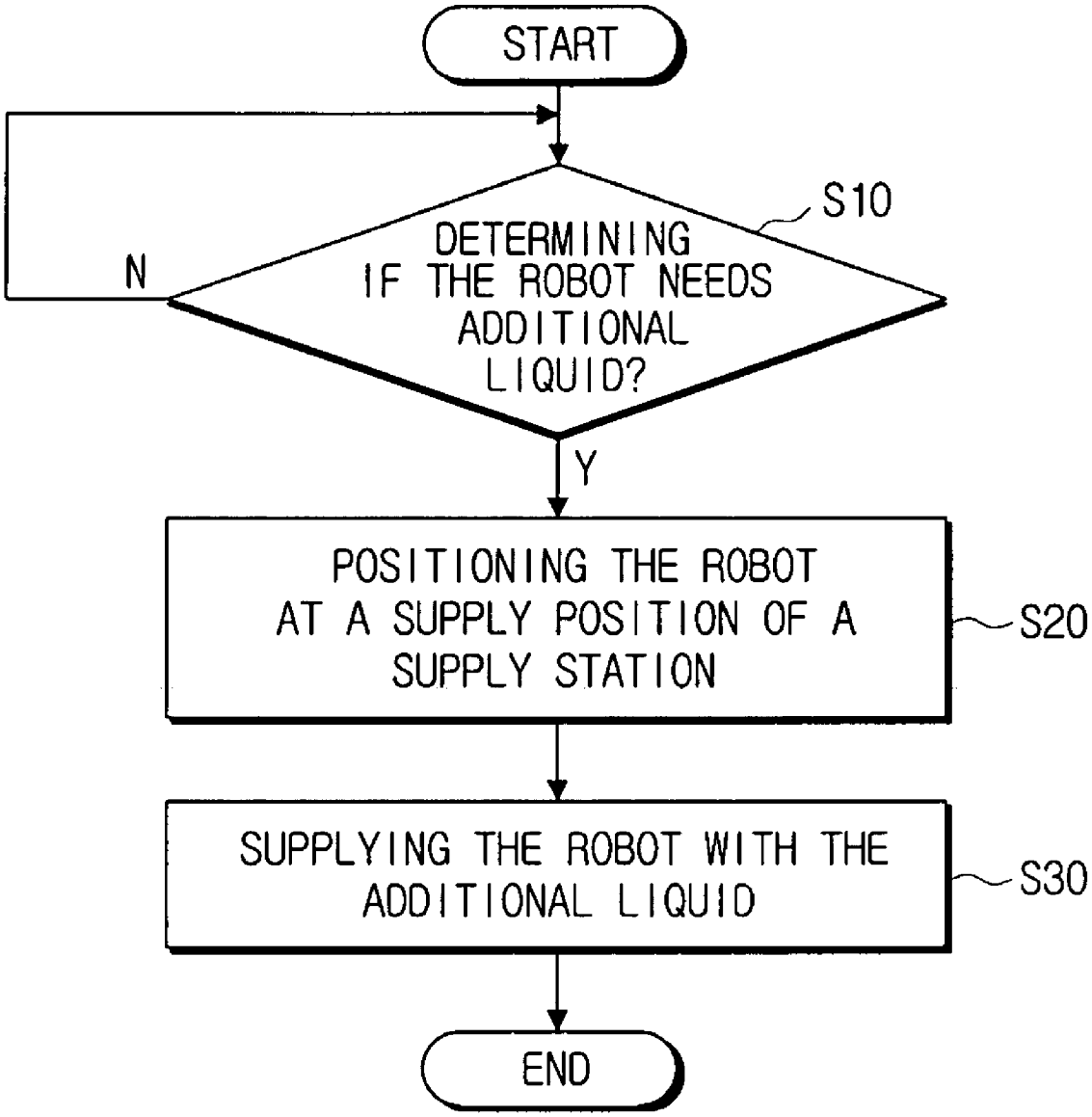
FIG. 11 is a flow chart showing a supply method for a robot system having a supply station.
Figure 12:
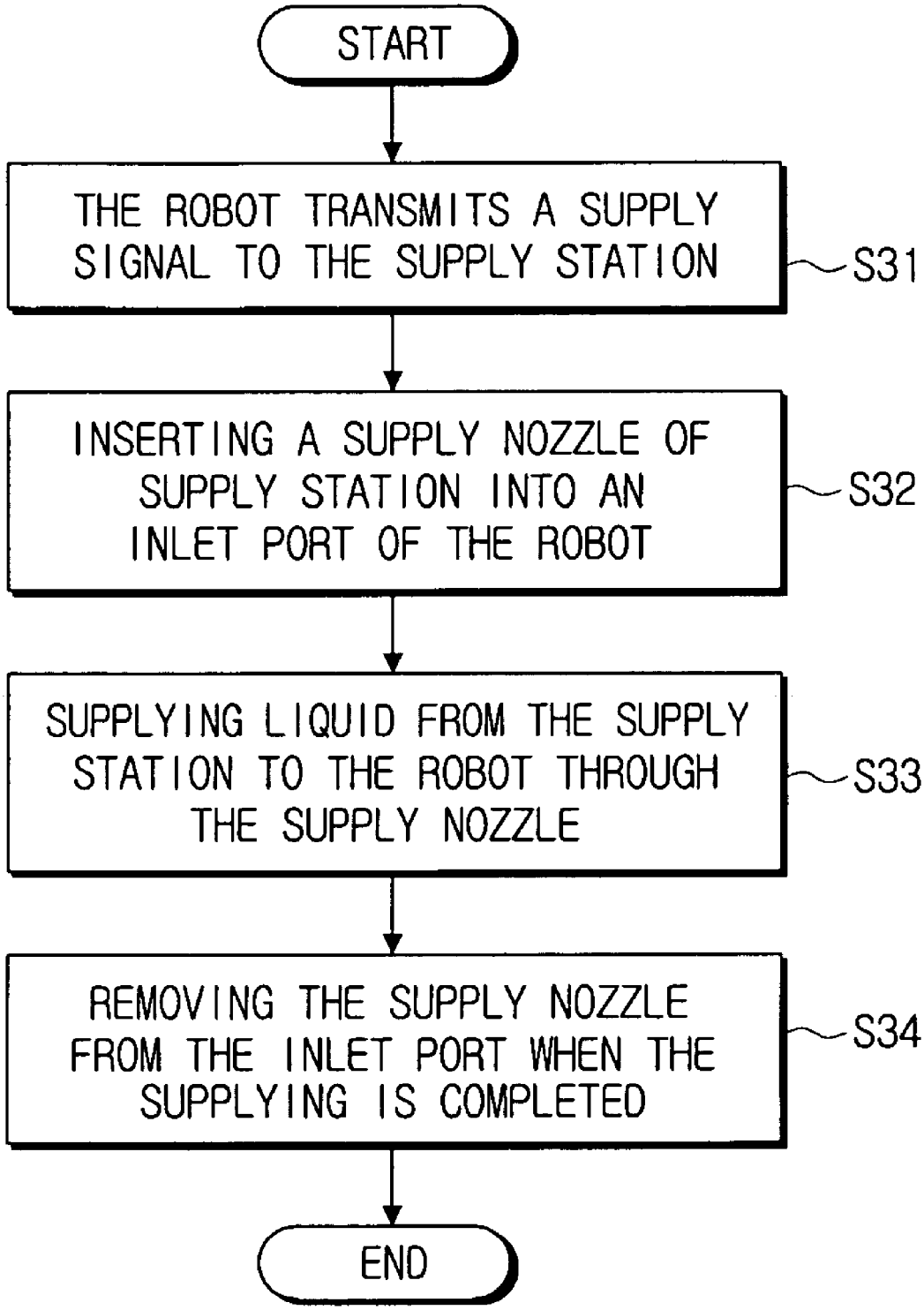
FIG. 12 is a flow chart showing non-limiting aspects of the supply method shown in FIG. 11.

Another aspect of the present invention is illustrated in FIGS. 11 and 12. In the robot system 1, 50, or 100 having supply station 10, 60, or 110, the robot 30, 80, or 140 may detect a level of the liquid being stored in the tank 37, 87, 147, or 151 and may determine if tank 37 or 87 is low (Step S10). When tank 37, 87, 147, or 151 is low, robot 30, 80, or 140 may stop its task and may move to a supply position at the supply station 10, 60, or 110 (Step S20).

When the robot 30, 80, or 140 locates the supply position of the supply station 10, 60, or 110, the supply station 10, 60, or 110 supplies the robot 30, 80, or 140 with the liquid (Step S30). Referring to FIG. 12, the procedure of supplying the liquid will be described in detail. When the robot 30, 80, or 140 is positioned at the supply position, a robot controller 40, 90, or 150 of the robot 30, 80, or 140 may transmit a supply signal to the liquid supply station 10, 60, or 110 (Step S31).

Upon receiving the supply signal, the supply station 10, 60, or 110 may insert a supply nozzle 16 or 66 into an inlet port of the tank 37, 87, 147, or 151 of the robot 30, 80, or 140 (Step S32). In other words, when a station controller 20, 70, or 130 of the supply station 10, 60, or 110 receives the supply signal, it may control a nozzle drive part of the supply nozzle unit 13, 63, 113, or 123 to move the supply nozzle 16 or 66 down. Then the supply nozzle 16 or 66 may be inserted into the inlet port of the tank 37, 87, 147, or 151 of the robot 30, 80, or 140.

When supply nozzle 16 or 66 is inserted into the inlet port of the tank 37, 87, 147, or 151, the supply station 10, 60, or 110 may supply the tank 37, 87, 147, or 151 with liquid through the supply nozzle 16 or 66 (Step S33). In other words, when the station controller 20, 70, or 130 of the supply station 10, 60, or 110 operates the pump 12, 62, 114, or 124, the liquid of the tank 11, 61, 111, or 121 is supplied to the tank 37, 87, 147, or 151 of the robot 30, 80 or 140 through a connection pipe 14, 64, 114, or 124 and the supply nozzle 16 or 66.

When re-supply of the liquid is completed, the supply station 10, 60, or 110 may remove the supply nozzle 16 or 66 from the inlet port of the robot 30, 80, or 140 (Step S34). In other words, when the tank 37, 87, 147, or 151 of the robot 30, 80, or 140 is filled with liquid, the station controller 20, 70, or 130 of the supply station 10, 60, or 110 may control the nozzle drive part to move the supply nozzle 16 or 66. Then the supply nozzle 16 or 66 may be removed from the inlet port of the tank 37, 87, 147 or 151. When the supply nozzle 16 or 66 is removed, the robot 30, 80, or 140 may resume the desired task.

While these non-limiting embodiments have described automatic refueling and refilling of fluid tanks, manual refueling and refilling are also within the scope of the present invention. While non-limiting embodiments of the present invention have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the invention.

What is claimed is:

1. A robot system including a supply station, the system comprising:

a robot including a dust suction unit and being adapted to travel autonomously;

a robot tank adapted to store a liquid and disposed at the robot; and a supply station configured to supply additional liquid to the robot tank, wherein when the robot is positioned at a supply position and a transmitting and receiving unit transmits a supply signal to the supply station, the supply station supplies additional liquid to the robot tank.

2. The robot system of claim 1, wherein the supply station comprises:

a storage tank;

a pump adapted to be in fluid communication with the storage tank;

a supply nozzle unit adapted to be in fluid communication with the pump;

a station controller configured to control the pump and the supply nozzle unit to supply the additional liquid to the robot tank.

3. The robot system of claim 2, wherein the supply nozzle unit comprises:

a supply nozzle;

a pipe configured to connect the supply nozzle and the pump; and a nozzle drive part configured to adjust a position of the supply nozzle, wherein when the supply nozzle moves down, a front end of the supply nozzle is configured to be inserted into an inlet port of the robot tank.

4. The robot system of claim 3, wherein:

the robot tank comprises an inlet port cap disposed at an inlet port of the robot tank, and the inlet port cap is configured to be opened and closed by the supply nozzle.

5. The robot system of claim 1, wherein the supply station comprises:

a level sensor configured to detect a level of the liquid stored in the liquid store tank; and a display part configured to display the detected level of the liquid.

6. A robot system including a supply station, the system comprising:

a robot including a dust suction unit and being adapted to travel autonomously using a fuel cell;

a robot tank disposed at the robot and configured to store a fuel for the fuel cell; and a supply station including a supply nozzle adapted for reciprocating movement, the supply station being configured to supply additional fuel by moving the supply nozzle downward upon receiving a supply signal from a transmitting and receiving unit of the robot.

7. The robot system of claim 6, wherein the supply station comprises:

a station storage tank;

a pump adapted to be in fluid communication with the station storage tank;

a pipe configured to connect the pump and a supply nozzle;

a nozzle drive part configured to move the supply nozzle; and a station controller configured to control the nozzle drive part to insert the supply nozzle into an inlet port of the robot tank.

8. The robot system of claim 7, wherein:

the robot tank comprises an inlet port cap disposed at the inlet port of the robot tank, and the inlet port cap is configured to be opened and closed by a movement of the supply nozzle.

9. A robot system including a supply station, the system comprising:

a robot including a dust suction unit and being adapted to travel autonomously and to use water to perform a task;

a robot tank disposed at the robot and configured to store the water; and a supply station connected to a water service pipe, the supply station being adapted to supply the robot tank fixed to the robot with additional water upon receiving a supply signal from a transmitting and receiving unit of the robot.

10. The robot system of claim 9, wherein the supply station comprises:

a station storage tank connected to the water service pipe and adapted to store water;

a pump configured to be in fluid communication with the station storage tank;

a supply nozzle unit configured to supply water from the station storage tank to the robot tank; and a station controller configured to control the pump and the supply nozzle unit to supply the additional water.

11. The robot system of claim 10, wherein the supply nozzle unit comprises:

a supply nozzle;

a pipe configured to connect the supply nozzle and the pump; and a nozzle drive part configured to adjust a position of the supply nozzle.

12. The robot system of claim 11, wherein:

the robot tank comprises an inlet port cap disposed in the inlet port of the robot tank, and the inlet port cap is configured to be opened and closed by a movement of the supply nozzle.

13. The robot system of claim 9, wherein the supply station comprises:

a valve disposed at the water service pipe and configured to open and close the water service pipe;

a supply nozzle unit configured to be in fluid communication with the valve and to serve as a passage through which the additional water flows from the water service pipe to the robot tank; and a station controller configured to control the valve and the supply nozzle unit.

14. A robot system including a supply station, the system comprising:

a robot being adapted to travel autonomously using power supplied from a fuel cell, adapted to use a liquid to complete a task, and adapted to operate a dust suction unit;

a fuel tank disposed at the robot;

a liquid tank disposed at the robot and storing water to be used for a task; and a supply station configured to supply additional fuel and additional liquid to the fuel tank and the liquid tank upon receiving a supply signal from a transmitting and receiving unit of the robot.

15. The robot system of claim 14, wherein the supply station comprises:

a station fuel tank;

a station liquid tank;

a first pump adapted to communicate with the fuel tank;

a second pump adapted to communicate with the liquid tank;

a first supply nozzle adapted to supply fuel from the station fuel tank;

a second supply nozzle adapted to supply liquid from the station liquid tank; and a controller configured to control supplying of fuel and liquid.

* * * * *